US007461645B2

(12) United States Patent
Williamson et al.

(10) Patent No.: US 7,461,645 B2
(45) Date of Patent: Dec. 9, 2008

(54) HAND HELD DISC LAUNCHER

(75) Inventors: Michael M. Williamson, Stateville, NC (US); Ward Myers, Wayzata, MN (US)

(73) Assignee: Hyper Products, Inc., Wayzata, MN (US)

( * ) Notice: Subject to any disclaimer, the term of this patent is extended or adjusted under 35 U.S.C. 154(b) by 400 days.

(21) Appl. No.: 11/342,241

(22) Filed: Jan. 27, 2006

(65) Prior Publication Data

US 2006/0191520 A1 Aug. 31, 2006

Related U.S. Application Data

(60) Provisional application No. 60/648,336, filed on Jan. 28, 2005.

(51) Int. Cl.
*F41B 3/03* (2006.01)

(52) U.S. Cl. ..... 124/20.1

(58) Field of Classification Search ..... 124/4, 124/5, 6, 7, 16, 17, 20.1, 36
See application file for complete search history.

(56) References Cited

U.S. PATENT DOCUMENTS

| | | | | |
|---|---|---|---|---|
| 186,334 | A | | 1/1877 | Frost |
| 498,070 | A | | 5/1893 | Monaghan |
| 539,183 | A | | 5/1895 | Lewis |
| 1,186,098 | A | | 6/1916 | Horst |
| 1,353,663 | A | | 9/1920 | Napier |
| 1,700,880 | A | | 2/1929 | Camp |
| 1,726,534 | A | * | 9/1929 | Berger ..... 124/2 |
| 2,056,446 | A | | 10/1936 | Dodge, Jr. ..... 124/14 |
| 2,318,139 | A | * | 5/1943 | Calabrese ..... 124/7 |
| 2,484,844 | A | | 10/1949 | Nicholas ..... 124/11 |
| 2,742,889 | A | | 4/1956 | Clauss ..... 124/26 |
| 2,755,788 | A | | 7/1956 | Edwards ..... 124/21 |
| 2,945,485 | A | | 7/1960 | Skreberg ..... 124/4 |
| 2,996,060 | A | | 8/1961 | Appleby ..... 124/41 |
| 3,794,325 | A | * | 2/1974 | Stender ..... 273/399 |
| 4,076,004 | A | | 2/1978 | Huelskamp ..... 124/5 |
| 4,233,952 | A | | 11/1980 | Perkins ..... 124/5 |
| 4,347,828 | A | | 9/1982 | Bridgeman ..... 124/5 |
| 4,730,595 | A | | 3/1988 | Glass et al. ..... 124/5 |
| 4,807,585 | A | | 2/1989 | Gegere ..... 124/21 |
| 4,957,092 | A | | 9/1990 | Rhodes ..... 124/20.1 |
| 4,984,556 | A | | 1/1991 | Glass et al. ..... 124/5 |
| D346,183 | S | | 4/1994 | Crane ..... D21/2 |
| 5,390,652 | A | | 2/1995 | Minneman et al. ..... 124/5 |
| D374,702 | S | | 10/1996 | Parks ..... D22/114 |
| 5,579,750 | A | | 12/1996 | Lease ..... 124/20.1 |

* cited by examiner

*Primary Examiner*—John Ricci
(74) *Attorney, Agent, or Firm*—Westman, Champlin & Kelly, P.A.; Z. Peter Sawicki

(57) ABSTRACT

A disc launcher for launching discs including a handle, a pivot arm pivotally attached to or proximate the handle. The pivot arm includes a disc holder. A frame is fixedly attached to or proximate the handle and extends forwardly. A spring mechanism is energized by pivoting the pivot arm to a launching position. The disc is placed in the disc holder such that when the pivot arm is released, the disc is launched into flight due to the force released by the spring mechanism.

15 Claims, 4 Drawing Sheets

HAND HELD DISC LAUNCHER

CROSS-REFERENCE TO RELATED APPLICATION

The present application is based on and claims the benefit of U.S. provisional patent application Ser. No. 60/648,336, filed Jan. 28, 2005, the content of which is hereby incorporated by reference in its entirety.

The present invention relates to an apparatus and method for launching discs. More particularly, the present invention relates to a hand held apparatus that propels discs such as clay targets that are sometimes called clay pigeons.

The prior art includes many types of hand held devices for throwing discs such as clay targets. These devices range from sling shot type arrangements, to catapult devices, or to whip like devices in which the disc is held at the end of a flexible arm and the flexible arm is whipped to throw the disc. Other devices and variations are generally combinations of the above described. Some examples of such prior art devices are described in the following patents:

| Inventor Name | Patent No. |
|---|---|
| Crane | Des. 346,183 |
| Parks | Des. 374,702 |
| C. W. Frost | 186,334 |
| J. Monaghan | 498,070 |
| E. L. Lewis | 539,183 |
| G. D. Horst | 1,186,098 |
| C. H. Napier | 1,353,663 |
| H. P. Camp | 1,700,880 |
| W. W. Dodge, Jr. | 2,056,446 |
| W. Nicholas | 2,484,844 |
| R. W. Clauss | 2,742,889 |
| J. S. Edwards | 2,755,788 |
| H. Skreberg | 2,945,485 |
| D. K. Appleby | 2,996,060 |
| Huelskamp | 4,076,004 |
| Perkins | 4,233,952 |
| Bridgeman | 4,347,828 |
| Glass et al. | 4,730,595 |
| Gegere | 4,807,585 |
| Rhodes | 4,957,092 |
| Glass et al. | 4,984,556 |
| Minneman et al. | 5,390,652 |
| Lease | 5,579,750 |

SUMMARY OF THE INVENTION

The present invention includes a handheld disc launcher. The launcher comprises a handle, a pivot arm having a disc holder and a forwardly extending frame fixedly attached to or proximate the handle. A spring mechanism is energized by pivoting the pivot arm to a position such that when the disc is placed in the disc holder, the pivot arm when released will launch the disc into flight due to the action of the spring mechanism.

DETAILED DESCRIPTION OF THE PREFERRED EMBODIMENT

Figure 1:
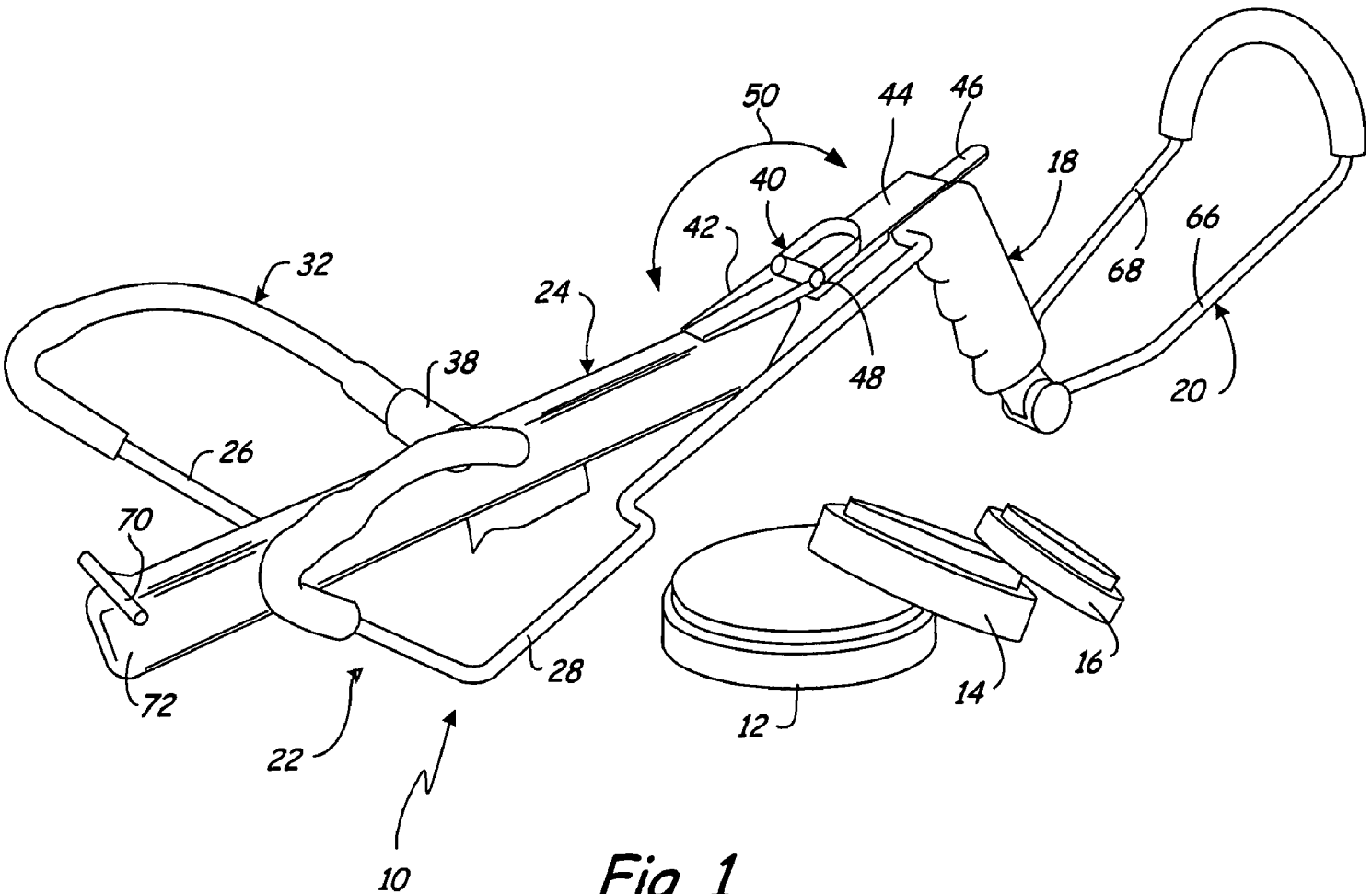
FIG. 1 is a perspective view of the disc launcher of the present invention.

The present invention includes a disc launcher generally indicated at 10 in FIG. 1. The disc launcher 10 launches discs such as clay targets or clay pigeons 12, 14 and 16. The launcher 10 can launch clay targets of various sizes such as depicted in FIG. 1 by clay pigeons 12, 14 and 16.

The launcher 10 is a hand held launcher and includes a handle 18 a forearm brace 20, a stationary frame 22 and a pivoting arm 24.

Figure 2:
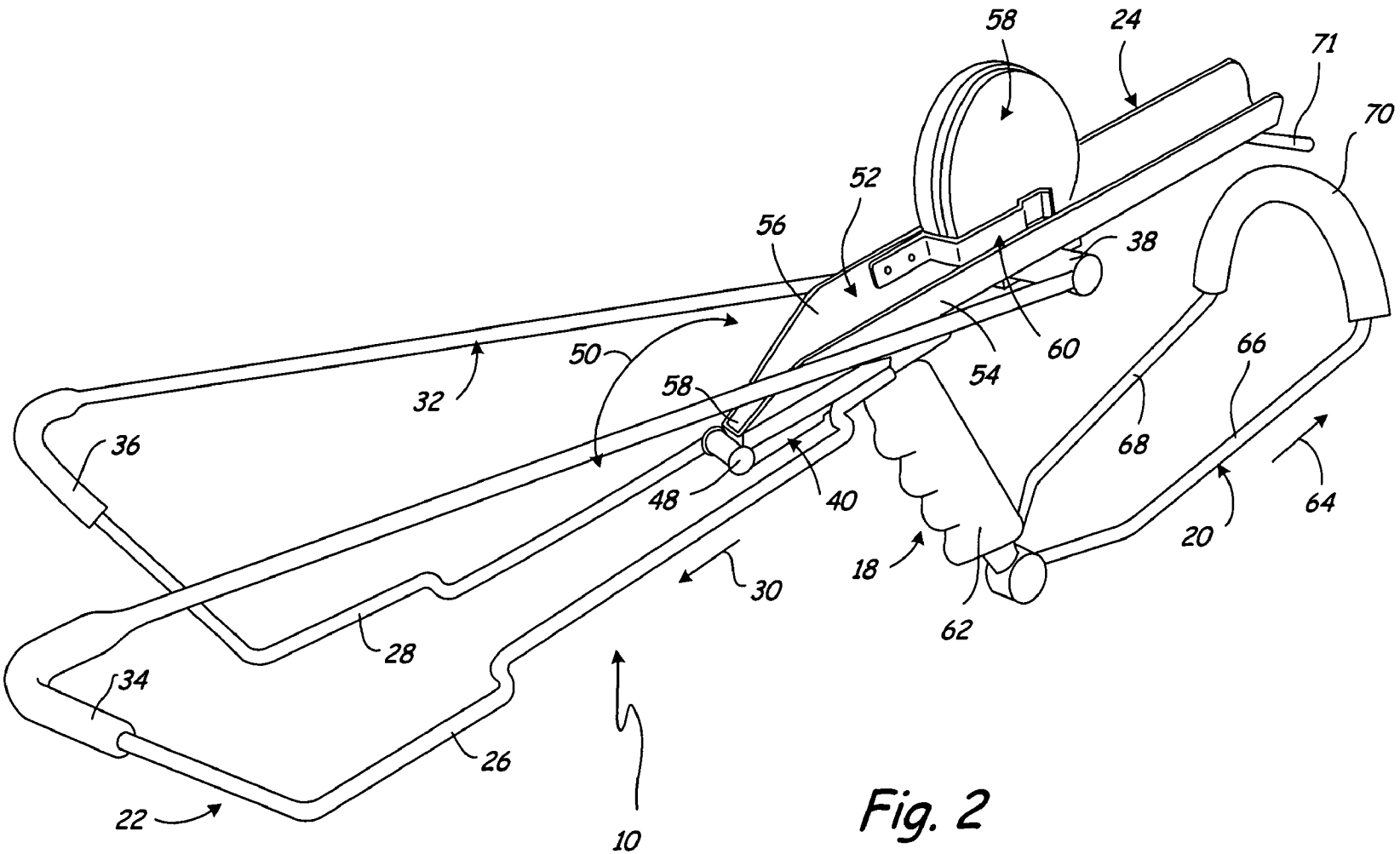
FIG. 2 is a perspective view of the disc launcher with a disc loaded thereon.

In the embodiment illustrated in the Figures, and specifically referring to FIG. 2, frame 22 includes left and right wire members 26 and 28 fixedly attached to the handle 18. The wire members are made of metal and are sufficiently resistant to bending when the launcher is being prepared to launch a disc. The wire members 26 and 28 extend in a forward direction, the direction being indicated by arrow 30. In the particular embodiment illustrated in the Figures, the left and right frame arms 26 and 28 diverge from each other as the arms 26 and 28 extend forward.

Two sections of surgical tubing 32 are attached one to each end of the arms 26 and 28 at tubing ends 34, 36 respectively and each section is attached at an opposite end to retaining tube 38. The surgical tubing 32 is made of an elastic polymer that when pulled stretches and provides power when it is permitted to contract. The surgical tubing is typically made of a latex or silicone polymer although other polymers which have the same or similar properties may be used. Such tubing maintains memory through repeated stretching/contracting cycles.

The retaining tube 38 is attached to an underside of the pivoting arm 24. The surgical tubing is attached to the retaining tube by being stretched over the tube 38 and being held by elastic and frictional forces. Surgical tubing 32 provides the launching force (kinetic energy) to the pivoting arm 24 as will be discussed subsequently. Although surgical tubing is specifically discussed other stretchable, resilient, or elastic materials such as solid plastic bands, rubber bands, leaf springs, coil springs, and other types of metal springs which can be energized when the pivoting arm gets pulled back to a launching position are also contemplated. The tubing 32 may be attached to the pivoting arm in other ways other than through tube 38 as illustrated in the Figures. Tubing 32 is attached through ends 34 and 36 to the end of the arms 26 and 28 by inserting the ends of the arms 26 and 28 into the tubing ends 34 and 36. The tubing is attached to the arms by frictional and elastic forces generated by the tubing as the tubing ends 34 and 36 engage the ends of arm members 26 and 28.

The pivoting arm 24 is attached to the handle 18 by a hinge 40 with one hinge section 42 secured to the pivoting arm 24 on an underside thereof, and the other hinge section 44 secured to the top of the handle 18 and a proximal end 46 of the frame members 26 and 28. Due to the hinge connection, the pivoting arm 24 pivots about hinge pin 48 as indicated by arrows 50.

The pivoting arm 24 further includes a channel 52 formed by spaced-apart left and right side walls 54 and 56 and a bottom wall 58. Channel 52 is sufficiently wide and deep to hold a clay target 58. A retaining clip 60 is secured to the right side wall 56 and has a section that is sufficiently spaced from the wall 56 to receive and retain a clay target 58 within the channel 52. The clip 60 is made of spring material such as spring metal and provides a slight spring force against the clay target 58 retaining the clay target against the side wall 56. The spring force need only be sufficient to retain the clay target in place when the device is tilted. The spring force, of course, cannot be so strong that the clay target is not released when the pivoting arm is launched as described below. Though an L-shaped clip is illustrated in the Figures, clips shaped differently or other types of retaining devices for retaining the clay target 58 in place on the pivoting arm are included within this invention.

Figure 3:
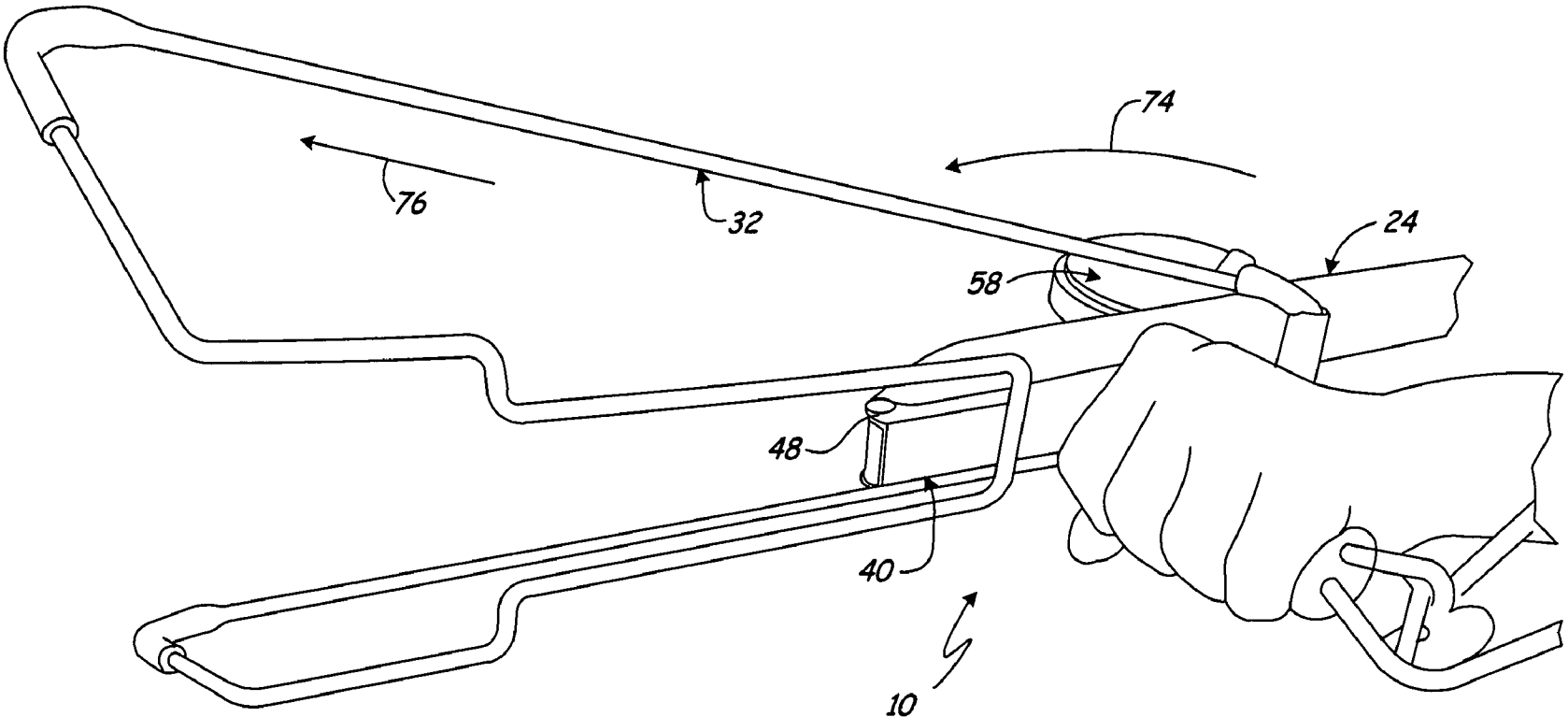
FIG. 3 is a perspective view of the disc launcher prior to launching a disc.

To further aid in using the device 10 of the present invention, a forearm brace 20 is attached to the lower end 62 of the handle 18. As illustrated, the handle 18 is in the form of a pistol grip. Forearm brace 20 in the embodiment illustrated in the Figures is made of a wire rod that extends in a rearward direction as referenced by arrow 64 in FIG. 2 and has left and right rod sections 66 and 68 that extend sufficiently apart so that a hand and accompanying forearm of the user can be positioned between sections 66 and 68 while a hand grabs the pistol grip 18 as illustrated in FIG. 3. A yoke section 70 that is formed by the wire rod that also forms the sections 66 and 68 forms the back end of the brace 20 as illustrated in FIG. 2. The yoke 70 lays on or engages the top of the user's forearm to provide a brace to help when cocking (pulling back the pivoting arm) the launcher and during launching of the disc.

To use the device of the present invention, a right handed person positions the left hand between the sections 66 and 68 of the brace 20 and grips the handle 18 with the left hand as illustrated in FIG. 3. The pivot arm further includes a pull rod 71 attached at a distal end 72. With the right hand, the user grabs the pull rod 71 and pulls back the pivot arm by pivoting the pivoting arm about the hinge pin 48 in the direction of arrow 50 against the force of the tubing 32, stretching the tubing. The channel 52 of the pivoting arm 24 faces upwardly once the pivoting arm is pivoted to rest on top of the handle 18, as illustrated in FIG. 2. Pivoting the pivot arm stretches the surgical tubing providing energy to the device 10. The wire members 26 and 28 are sufficiently rigid to withstand the force of the stretched tubing when the pivot arm is pulled back and cocked. When the pivoting arm 24 is pulled back, that is moved approximately 180°, the pivot arm will rest and stay in position without much effort needed by the user to retain the pivoting arm even though the surgical tubing is stretched.

To launch the clay target 28, the device 10 is tilted, as illustrated in FIG. 3, to a position substantially horizontal so that the clay target 58 spins in a substantially horizontal position enabling the disc to fly. To launch the clay target 58, the pivot arm 24 is pushed slightly forwardly and released. The surgical tubing 32 will contract, pivoting the pivot arm 24 about the hinge pin 48 of the hinge 40 in the general direction of arrow 74. The disc, it is believed, then rolls along the channel imparting the spin which is needed for stable flight. The thrust of the pivot arm provides forward motion to the disc. The result is that the clay target 58 is launched spinning into flight in the general direction indicated by arrow 76. As will be appreciated, the brace 20 aids in pulling back the pivot arm 24 providing support through interaction with the user's forearm while the tubing 32 is stretched to move the pivot arm into the launching position. Once the disk is launched, with the pivoting arm swinging about the hinge pin 48, the brace may also absorb some of the torque produced by the pivot arm when it proceeds to its forward most position during the launching.

Figure 4:
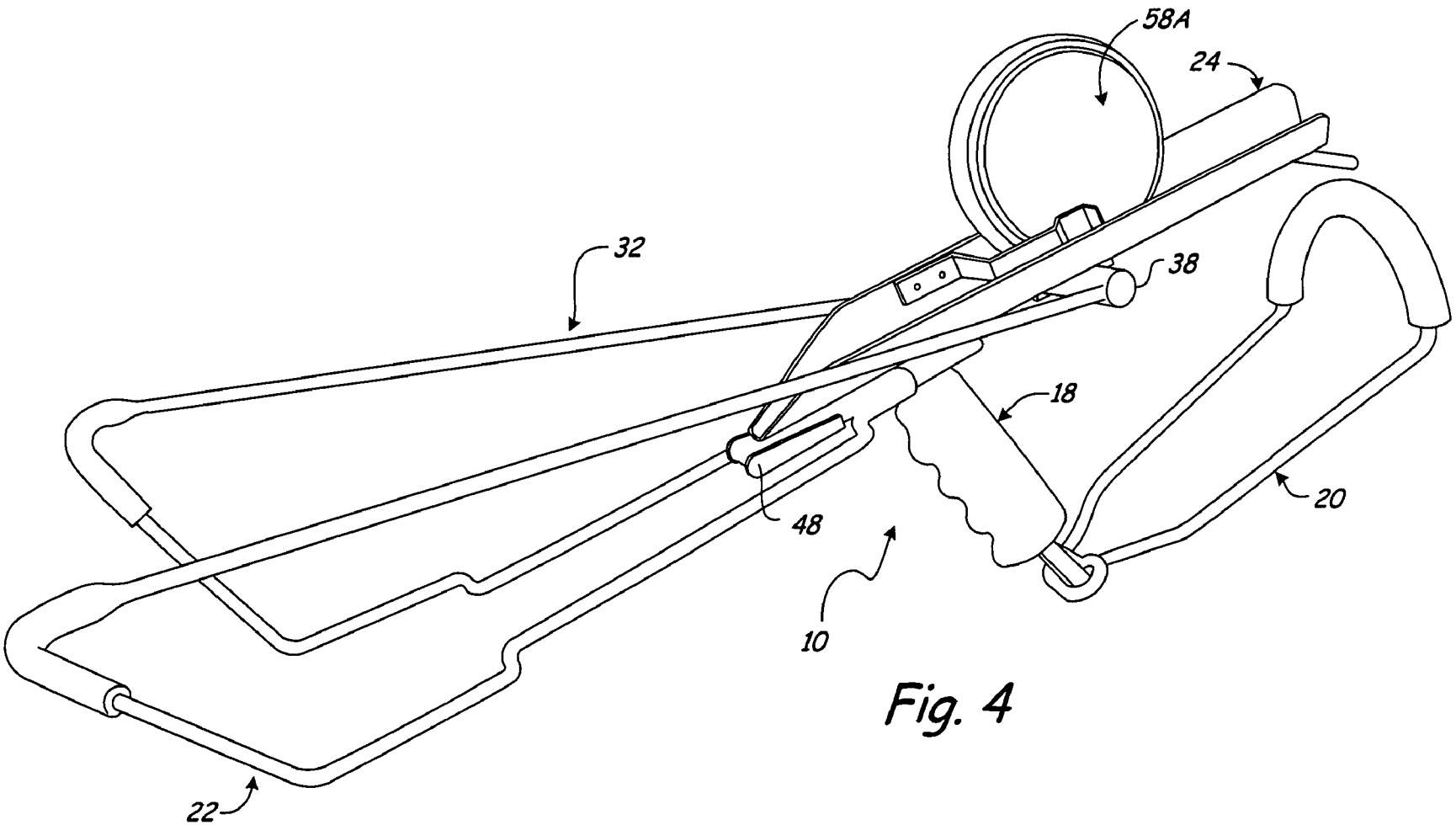
FIG. 4 is a perspective view of the disc launcher with a disc that is different in size than the disc illustrated in FIG. 2.

FIG. 4 illustrates the device 10 of the present invention with a disc 58A that is of a different size than the disc 58 shown in FIG. 2.

Although the present invention has been described with reference to preferred embodiments, workers skilled in the art will recognize that changes may be made in form and detail without departing from the spirit and scope of the invention.

The invention claimed is:

1. A hand held disc launcher for launching a disc, the launcher comprising:

a handle;

an arm brace attached to the handle;

a pivot arm pivotally attached to or proximate the handle and having a disc holder;

a frame fixedly attached to or proximate the handle and extending forwardly; and a spring mechanism that is energized by pivoting the pivot arm to a position such that when the disc is placed in the disc holder, the pivot arm when released will launch the disc in to flight due to the action of the spring mechanism.

2. The disc launcher of claim 1 wherein the spring mechanism comprises surgical tubing that is attached at one end to the frame and at another end to the pivot arm such that the surgical tubing is stretched when the pivot arm is pivoted to a launching position.

3. The disc launcher of claim 1 wherein the arm brace includes spaced-apart members extending from the handle and being spaced sufficiently apart such that a forearm is positionable there between.

4. The disc launcher of claim 3 wherein the arm brace further includes a yoke section wherein the first second members terminate in the yoke section such that the yoke section will rest on the forearm.

5. The disc launcher of claim 1 wherein the arm brace is pivotally attached to the handle.

6. The disc launcher of claim 1 wherein the disc holder includes a channel defined by a bottom wall and spaced apart side walls and sufficiently wide and deep to hold the disc.

7. The disc launcher of claim 6 further including a disc retaining member for retaining the disc in the channel.

8. The disc launcher of claim 7 wherein the retaining member is made of a spring material that supplies sufficient force to retain the disc within the channel but releases the disc when the pivoting arm is launched.

9. A method for launching a disc using a manually held disc launcher, the disc launcher having a disc holder pivotally attached to a handle at one end secured at a forward position to a spring mechanism; the method comprising:

holding the disc launcher by its handle with a hand;

pivoting the disc holder back against the force of the spring mechanism to a launching position;

positioning a disc within the disc launcher by releasably securing the disc within the launcher through the use of a retaining spring clip; and releasing the disc launcher such that the force of the spring mechanism pivots the disc launcher forward throwing the disc into flight.

10. A hand held disc launcher for launching a disc, the launcher comprising:

a handle;

an arm brace attached to the handle;

a pivot arm pivotally attached to or proximate the handle and having a disc holder;

a frame fixedly attached to or proximate the handle and extending forwardly; and a spring mechanism that is energized by pivoting the pivot arm to a position such that when the disc is placed in the disc holder, the pivot arm when released will launch the disc in to flight due to the action of the spring mechanism;

wherein the disc holder includes a channel defined by a bottom wall and spaced apart side walls and sufficiently wide and deep to hold the disc.

11. The disc launcher of claim 10 wherein the spring mechanism comprises surgical tubing that is attached at one end to the frame and at another end to the pivot arm such that the surgical tubing is stretched when the pivot arm is pivoted to a launching position.

12. The disc launcher of claim 11 wherein the arm brace includes spaced-apart members extending from the handle and being spaced sufficiently apart such that a forearm is positionable there between.

13. The disc launcher of claim 10 wherein the arm brace further includes a yoke section wherein the first second members terminate in the yoke section such that the yoke section will rest on the forearm.

14. The disc launcher of claim 10 further including a disc retaining member for retaining the disc in the channel.

15. The disc launcher of claim 14 wherein the retaining member is made of a spring material that supplies sufficient force to retain the disc within the channel but releases the disc when the pivoting arm is launched.

* * * * *